US008893535B2

(12) United States Patent
Zimmer

(10) Patent No.: US 8,893,535 B2
(45) Date of Patent: Nov. 25, 2014

(54) CYLINDER HOUSING

(71) Applicant: Dr. Ing. h.c. F. Porsche Aktiengesellschaft, Stuttgart (DE)

(72) Inventor: Jens Zimmer, Wiernsheim-Iptingen (DE)

(73) Assignee: Dr. Ing. h.c. F. Porsche Aktiengesellschaft (DE)

( * ) Notice: Subject to any disclaimer, the term of this patent is extended or adjusted under 35 U.S.C. 154(b) by 0 days.

(21) Appl. No.: 14/088,508

(22) Filed: Nov. 25, 2013

(65) Prior Publication Data

US 2014/0144194 A1 May 29, 2014

(30) Foreign Application Priority Data

Nov. 29, 2012 (DE) ..... 10 2012 111 606

(51) Int. Cl.

| | |
|---|---|
| ***E05B 9/08*** | (2006.01) |
| ***E05B 15/16*** | (2006.01) |
| ***E05B 9/04*** | (2006.01) |
| ***E05B 85/02*** | (2014.01) |
| *E05B 77/44* | (2014.01) |

(52) U.S. Cl.

CPC . *E05B 85/02* (2013.01); *E05B 9/04* (2013.01); *E05B 77/44* (2013.01); *E05B 2015/1664* (2013.01)

USPC ..... 70/370; 70/373; 70/417; 70/451; 70/466

(58) Field of Classification Search

USPC ..... 70/370, 373, 448, 449, 371, 372, 417, 70/451, 466

See application file for complete search history.

(56) References Cited

U.S. PATENT DOCUMENTS

| | | | | | |
|---|---|---|---|---|---|
| 3,209,568 | A | * | 10/1965 | Patriquin | 70/373 |
| 3,981,168 | A | | 9/1976 | Vanelli Coralli et al. | |
| 4,083,211 | A | * | 4/1978 | Scherbing | 70/491 |
| 4,147,905 | A | * | 4/1979 | Scherbing | 200/43.08 |
| 4,662,198 | A | * | 5/1987 | Scherbing | 70/491 |
| 5,297,405 | A | * | 3/1994 | Manning et al. | 70/208 |
| 5,487,287 | A | * | 1/1996 | Viggiano | 70/86 |
| 5,678,438 | A | * | 10/1997 | Kolkman et al. | 70/370 |
| 5,730,011 | A | * | 3/1998 | Terai | 70/186 |
| 5,819,560 | A | * | 10/1998 | Grahovec et al. | 70/38 A |
| 6,094,950 | A | * | 8/2000 | Maynard et al. | 70/81 |
| 6,318,026 | B1 | * | 11/2001 | Ayres et al. | 49/503 |
| 6,412,317 | B1 | * | 7/2002 | Martin | 70/81 |

(Continued)

FOREIGN PATENT DOCUMENTS

| | | |
|---|---|---|
| DE | 25 36 804 | 3/1976 |
| DE | 31 34 471 | 3/1983 |

(Continued)

OTHER PUBLICATIONS

German Search Report of Oct. 14, 2013.

*Primary Examiner* — Loyd Gall

(74) *Attorney, Agent, or Firm* — Gerald E. Hespos; Michael J. Porco; Matthew T. Hespos

(57) ABSTRACT

A lock cylinder of a motor vehicle has a cylinder housing formed from plastic and the cylinder housing has an opening for receiving a cylinder core. The plastic of the cylindrical housing is reinforced at least in certain regions with aramid fibers. Thus, the cylinder housing is extremely robust and increases the forcing resistance of a door lock equipped therewith.

6 Claims, 1 Drawing Sheet

(56) References Cited

U.S. PATENT DOCUMENTS

| | | | | |
|---|---|---|---|---|
| 7,634,929 | B2 * | 12/2009 | Kuhnke et al. | 70/375 |
| 7,854,153 | B2 * | 12/2010 | Lennhoff et al. | 70/370 |
| 8,104,314 | B2 * | 1/2012 | Mueller et al. | 70/370 |
| 8,256,254 | B2 * | 9/2012 | Bellamy | 70/278.7 |
| 8,646,294 | B1 * | 2/2014 | Derman | 70/58 |
| 2010/0218567 | A1 * | 9/2010 | Victor | 70/57.1 |
| 2011/0302969 | A1 * | 12/2011 | Mizumoto | 70/449 |

FOREIGN PATENT DOCUMENTS

| | | |
|---|---|---|
| DE | 299 12 034 | 9/1999 |
| DE | 10 2004 039 505 | 6/2005 |
| DE | 10 2008 001 627 | 11/2009 |
| DE | 10 2009 020 448 | 11/2010 |
| EP | 0 655 539 | 5/1995 |
| EP | 1 053 918 | 11/2000 |

* cited by examiner

CYLINDER HOUSING

CROSS REFERENCE TO RELATED APPLICATION

This application claims priority under 35 USC 119 to German Patent Appl. No. 10 2012 111 606.7 filed on Nov. 29, 2012, the entire disclosure of which is incorporated herein by reference.

BACKGROUND

1. Field of the Invention

The present invention relates to a cylinder housing for a lock cylinder of a motor vehicle. The invention also relates to a motor vehicle equipped with at least one such cylinder housing.

2. Description of the Related Art

Lock devices for motor vehicles usually have a cylinder housing and a cylinder core is mounted rotatably in the cylinder housing. The cylinder housings known from the prior art are produced, for example, from metal, in particular in a zinc die casting process. Such cylinder housings have required mechanical properties, but are relatively expensive to produce and have a high weight.

DE 10 2008 001 627 A1 discloses a cylinder housing for a lock cylinder of a motor vehicle. An opening is arranged in the longitudinal direction of the cylinder housing and a cylinder core can be received in the opening. The cylinder housing is formed from plastic, but has an embedded reinforcing inlay formed from a material stronger than the plastic. This has the aim of producing a strong, low weight cylinder housing that spares raw material resources, in particular metallic raw material resources.

EP 1 053 918 A2 discloses a long-fiber-reinforced plastic housing for a lock cylinder of a motor vehicle.

DE 25 36 804 A1 discloses a cylinder housing for a lock cylinder of a motor vehicle where the cylinder housing is made of plastic with embedded glass fibers.

DE 31 34 471 C2 discloses a cylinder housing made of plastic with embedded carbon fibers.

EP 0 655 539 B1 and DE 299 12 034 U1 disclose fiber-reinforced lock parts for lock devices of a motor vehicle.

An object of the invention is to provide a cylinder housing that is distinguished by a lightweight and extremely strong design.

SUMMARY OF THE INVENTION

The invention relates to a cylinder housing for a lock cylinder of a motor vehicle. The cylinder housing is formed from plastic and the plastic is reinforced at least in certain regions with aramid fibers or fibers having comparable properties. Aramid fibers of this type are commonly also known under the name "Kevlar fibers". Aramid is in this respect generally a designation for aromatic polyamides, and these polymer materials have a similar structure to proteins. According to a definition of the US Federal Trade Commission, only those long-chain synthetic polyamides in which at least 85% of the amide groups are bound directly to two aromatic rings are designated as aramids. In general terms, aramid fibers are distinguished by a very high strength, high impact strength, a high elongation at break, good vibration damping and also a first-class resistance to acids and alkalis. They are additionally heat-resistant and flame-resistant and do not melt at high temperatures, but rather begin to carbonize from a temperature of approximately 400° C. The reinforcement of the cylinder housing by aramid fibers makes it possible to increase the strength of the cylinder housing considerably, with a weight that is reduced considerably compared to metallic cylinder housings.

The invention also increases break-in resistance considerably, particularly in the region of screw-on points where the cylinder housing is screwed onto the motor vehicle. Reinforcing such screw-on points with aramid fibers increases the stability of the lock device as a whole.

The aramid fibers preferably are embedded in or laminated onto the plastic of the cylinder housing. The aramid fibers can be embedded, for example, by insertion into an appropriate plastics injection mold, where the aramid fibers can be configured, for example, as woven fabric plies that provide an internal reinforcement of the cylinder housing. Alternatively, the aramid fibers can be laminate to the plastic of the cylinder of the housing by both cold and/or hot lamination. In both cases, the aramid fibers, which may be configured as a woven fabric ply, may be bonded to the plastic cylinder housing by an adhesive layer. The lamination of the aramid fibers onto the cylinder housing made of plastic has the major advantage that, depending on the equipment variant, the cylinder housing can be installed optionally with or without additional aramid fibers, thereby giving rise to a relatively flexible production process. The cylinder housing is provided without additional aramid fibers in the case of certain equipment variants, whereas aramid fibers are laminated on cylinder housings in higher-value equipment variants.

The plastic of the cylinder housing may be reinforced with embedded carbon fibers. Carbon fibers are industrially produced fibers made from carbon-containing starting materials that are converted, by pyrolysis, into carbon in graphite configuration. The diameter of carbon fibers is usually between 5 and 8 μm, with several thousand such individual fibers (filaments) being combined to form a roving. Carbon fibers are distinguished by a high strength and a low weight and as a result are suitable in particular for reinforcing plastic components. Carbon fibers of this type may be configured in the manner of woven fabrics and, like comparable aramid woven fabrics, form particular protection against penetration. In this case, it is of course possible, depending on the desired strength, for a plurality of carbon fiber plies or aramid fiber plies to be arranged one above another in or on the cylinder housing.

Further important features and advantages of the invention become apparent from the drawings and from the associated description of the figures with reference to the drawings.

The features mentioned above and those still to be explained below can be used not only in the combination given in each case but also in other combinations or on their own, without departing from the scope of the invention.

Preferred exemplary embodiments of the invention are shown in the drawings and are explained in more detail in the following description, where the same reference signs refer to identical or similar or functionally identical components.

DETAILED DESCRIPTION OF THE PREFERRED EMBODIMENTS

Figure 1:
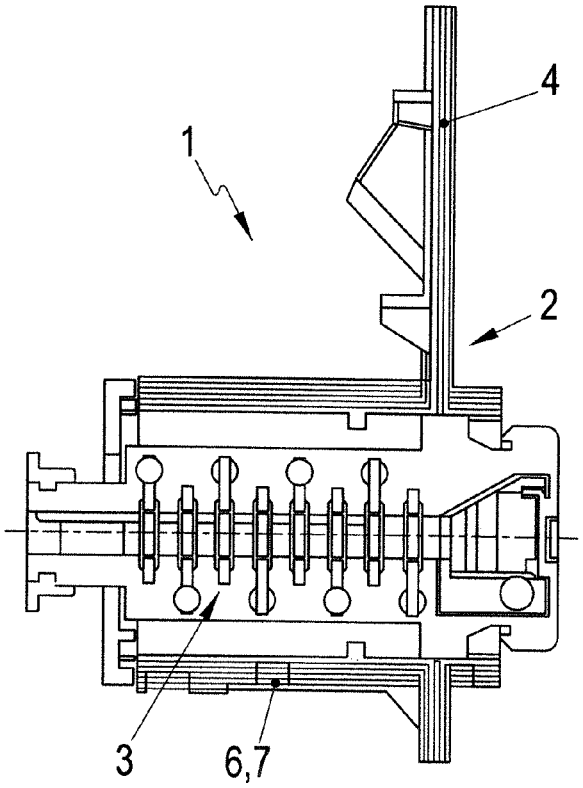
FIG. 1 is a sectional illustration through a cylinder housing according to the invention with a lock cylinder arranged therein.
Figure 2:
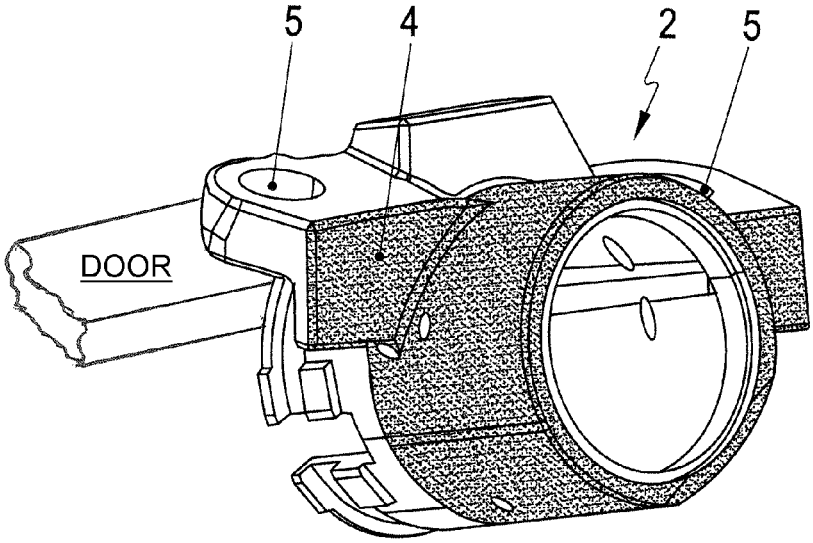
FIG. 2 is an oblique view of a cylinder housing according to the invention.

FIG. 1 shows a lock device 1 for a door lock of a door of a motor vehicle, the lock device 1. The lock device 1 has a cylinder housing 2 and a lock cylinder 3 arranged therein. The cylinder housing 2 is formed from plastic that is reinforced at least in certain regions with aramid fibers 4. In this case, the aramid fibers 4 can be embedded in the plastic of the cylinder housing 2, as is shown in FIG. 1 or can be laminated onto the plastic of the cylinder housing 2, as shown in FIG. 2. In both cases, the aramid fibers 4 stiffen or reinforce the cylinder housing 2 and additionally afford effective shatter protection. Thus, the cylinder housing 2 and particularly screw-on points 5 will not be destroyed by the action of a misuse force, for example when forcing the lock device 1. The screw-on points 5 are shown in FIG. 2 and function for the screwing of the lock device 1 onto the motor vehicle (not shown), for example onto a shell of a motor vehicle door.

The aramid fibers 4 can be embedded in the plastic of the cylinder housing 2 by inserting the aramid fibers 4 into a plastics injection mold and encapsulated the aramid fibers 4 by the plastic upon injection molding of the cylinder housing. As an alternative, the aramid fibers 4 can be laminated on and bonded to the cylinder housing 2 by an adhesive layer. The aramid fibers 4 can be bonded to the cylinder housing 2 as individual strands of fiber or as a woven fabric. The lamination affords the major advantage that the layer containing the aramid fibers 4 is applied merely purely optionally to the cylinder housing 2, so that the latter can be provided optionally with or without aramid fibers 4, for example depending on the value of the equipment line.

In addition to the aramid fibers 4, the cylinder housing 2 can be reinforced with further fibers, for example with carbon fibers 6 or with glass fibers 7. These are usually embedded in the plastic of the cylinder housing 2.

The cylinder housing 2 of the invention makes it possible to provide a component in particular with a considerably increased strength and resistance, which in particular also contributes to increasing the theft protection of a motor vehicle equipped with such a lock device 1 or with such a cylinder housing 2.

What is claimed is:

1. A cylinder housing for a lock cylinder of a motor vehicle, the cylinder housing comprising: a hollow cylindrical wall for holding the lock cylinder therein and mounting flanges projecting out from the cylindrical wall, screw-on points formed on the mounting flanges for mounting the cylinder housing to the motor vehicle, the cylinder housing being formed from plastic reinforced with a woven fabric of aramid fibers laminated onto the mounting flanges for providing shatter protection of the screw-on points against an action of misuse force.

2. The cylinder housing of claim 1, further comprising aramid fibers embedded in the plastic of the cylinder housing.

3. The cylinder housing of claim 1, further comprising carbon fibers or glass fibers embedded in the plastic.

4. A theft-protected motor vehicle, comprising:

a door;

a cylinder housing having a hollow cylindrical wall and screw-on points secured to the door of the motor vehicle;

a lock cylinder disposed in the hollow cylindrical wall of the cylinder housing; and a reinforcing fabric comprising aramid fibers laminated to at least regions of the cylinder housing having the screw-on points to provide shatter protection to at least areas of the cylinder housing secured to the door of the vehicle to protect against an action of misuse force.

5. The motor vehicle of claim 4, wherein the cylinder housing is made of plastic and has carbon fibers embedded therein.

6. A lock adapted to be mounted to a motor vehicle, comprising:

a cylinder housing having a hollow cylindrical wall and mounting flanges projecting out from the cylindrical wall, screw-on points formed on the mounting flanges for mounting the cylinder housing to the motor vehicle, the cylinder housing being formed from plastic with carbon fibers or glass fibers embedded therein;

a lock cylinder disposed in the hollow cylindrical wall of the cylinder housing; and a reinforcing fabric comprising aramid fibers laminated to at least the mounting flanges of the cylinder housing for providing shatter protection of the screw-on points against an action of misuse force.

* * * * *